US005506556A

United States Patent [19]

Baumgartl et al.

[11] Patent Number: 5,506,556

[45] Date of Patent: Apr. 9, 1996

[54] CIRCUIT BREAKER MECHANISM

[75] Inventors: Walter A. Baumgartl, Boksburg; Jacobus L. J. Sosef; Kishor S. Daya, both of Johannesburg, all of South Africa

[73] Assignee: Circuit Breaker Industries Limited, South Africa

[21] Appl. No.: 271,130

[22] Filed: Jul. 6, 1994

[30] Foreign Application Priority Data

Jul. 6, 1993 [ZA] South Africa ..... 93/4838

[51] Int. Cl.[6] ..... H01H 9/00

[52] U.S. Cl. ..... 335/172; 335/23

[58] Field of Search ..... 335/23–25, 167–176, 335/35

[56] References Cited

U.S. PATENT DOCUMENTS 3,566,320 2/1971 Bakes ..... 335/176

5,066,935 11/1991 Harper ..... 335/172

*Primary Examiner*—Lincoln Donovan

*Attorney, Agent, or Firm*—Ladas & Parry

[57] ABSTRACT

A circuit breaker actuating mechanism has a magnetic frame and a load coil, with a magnetic pole piece which is aligned with the axis of the coil. An elongate L-shaped armature pivots on the magnetic frame and has a head which moves transversely relative to the axis of the coil towards the pole piece. The pole piece is typically circular in section, and the head of the armature has a circular recess which matches the shape of the pole piece. The head of the armature has a pair of projections which extend relatively close to the pole piece when the armature is in a retracted position, increasing the initial attractive force between the pole piece and the armature. The mechanism is relatively simple and economical to manufacture, and offers an improved pull-in force.

7 Claims, 2 Drawing Sheets

CIRCUIT BREAKER MECHANISM

BACKGROUND OF THE INVENTION

THIS invention relates to a circuit breaker actuating mechanism.

A conventional circuit breaker has a coil which carries a load current and which is disposed in relation to a magnetic frame so that current in the coil causes a magnetic flux in the frame. The coil has a pole piece at one end, which concentrates the magnetic flux, and an armature which is typically pivoted on or adjacent to the magnetic frame and which is attracted axially towards the pole piece. The armature and its associated components must be formed accurately and must pivot freely if the circuit breaker is to be reliable and have predictable operating characteristics. This tends to increase the cost of the circuit breaker.

SUMMARY OF THE INVENTION

According to the invention a circuit breaker actuating mechanism comprises:

a magnetic frame;

a coil arranged to carry a load current and defining an axis;

a magnetic pole piece aligned with the axis of the coil and arranged to concentrate magnetic flux due to current in the coil; and an armature supported by the magnetic frame and being movable transversely relative to the axis of the coil towards the pole piece due to magnetic attraction between the armature and the pole piece.

The armature may be elongate and have a head shaped complementally to the shape of the pole piece.

The armature is preferably L-shaped and is connected to the magnetic frame at the top of the L, with the head of the armature formed in the foot of the L.

The pole piece may be circular in section, with the head of the armature having a complemental circular recess formed therein.

The head of the armature preferably defines at least one projecting end portion which is disposed relatively close to the pole piece when the armature is in a retracted position, to increase the initial attractive force between the pole piece and the armature when the armature is pulled in.

The clearance between the at least one projecting end portion of the head of the armature and the pole piece is preferably at least twice as small as the clearance between a central portion of the head of the armature and the pole piece.

The armature may have a retaining formation at the end thereof opposite the head which engages a complemental formation formed in the magnetic frame, to allow pivotal movement of the armature relative to the frame.

The retaining formation of the armature is preferably a projecting tab and the complemental formation in the magnetic frame is preferably an aperture which receives the tab.

The armature may be biased into a retracted position away from the pole piece by a leaf spring connected to the armature and bearing, in use, on a formation defined by a housing in which the mechanism is retained.

DESCRIPTION OF AN EMBODIMENT

Figure 1:
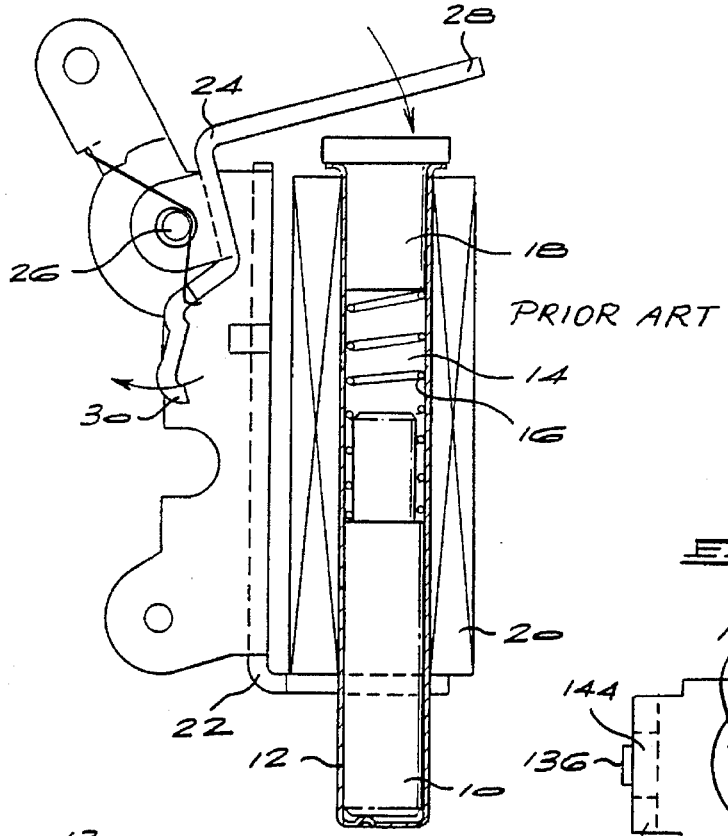
FIG. 1 is a partial sectional side view of a conventional hydraulic-magnetic circuit breaker actuating mechanism.

The prior art circuit breaker mechanism shown in FIG. 1 uses the "hydraulic-magnetic" system of the applicant, in which a magnetic core or plunger 10 is movable in a sealed tube 12 filled with hydraulic fluid 14, against the urging of a coil spring 16, towards a pole piece 18 which is pressed into the open end of the tube.

The tube extends through a coil 20 and is supported by a magnetic frame 22 which also supports an armature 24 on a pivot pin 26. The armature has a plate 28 which extends adjacent to the pole piece 18 and which moves towards the pole piece in the direction of the arrow when the current in the coil 20 creates a sufficiently large magnetic flux in the magnetic frame.

In the case of a moderate overcurrent, the force on the magnetic plunger 10 due to the increased magnetic flux exceeds the force exerted by the spring 16, and the plunger begins to move towards the pole piece 18, closing the magnetic gap between them. The plate 28 of the armature is attracted to the pole piece 18, rotating the armature 24 about its pivot pin 26, causing the other end 30 of the armature to move outwardly in the direction of the arrow, and unlatching a mechanism (not shown) which opens the circuit breaker contacts. In the case of severe overcurrents or short circuits, enough magnetic force is created to attract the armature towards the pole piece instantly, without the delay caused by the movement of the plunger 10 towards the pole piece 18.

Figure 3A:
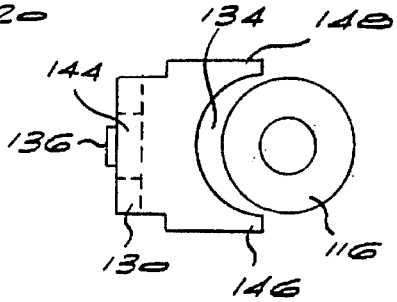
FIG. 3 is a top view of the actuating mechanism of FIG. 2, showing the complemental shape of the armature and pole piece.
Figure 2:
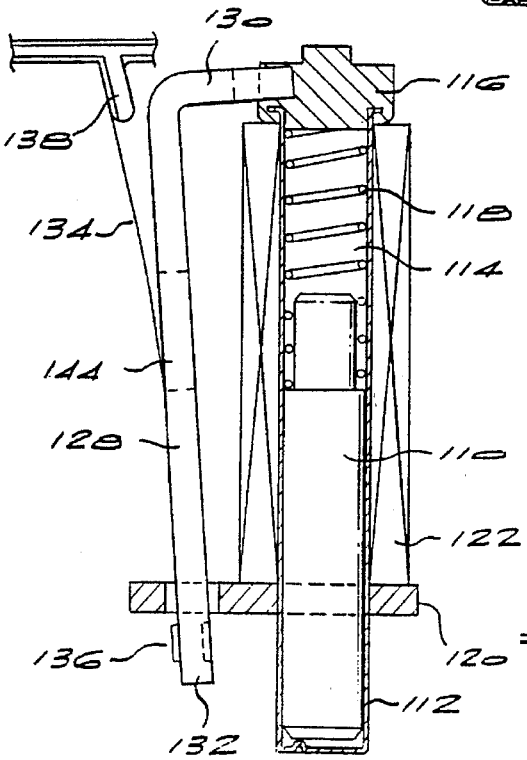
FIG. 2 is a partial sectional side view of the circuit breaker actuating mechanism of the invention.
Figure 3C:
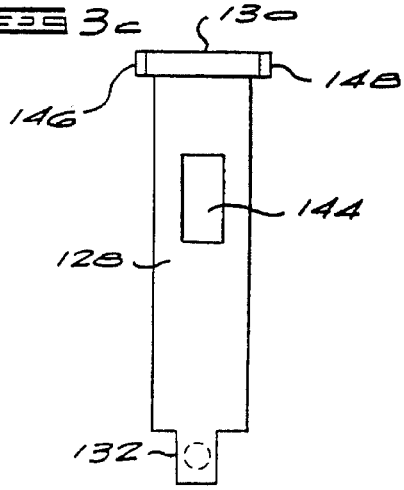
Figure 3B:
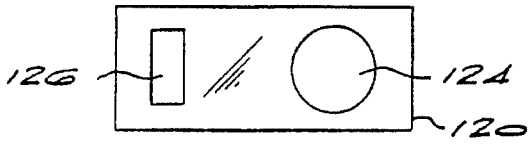
Figure 4:
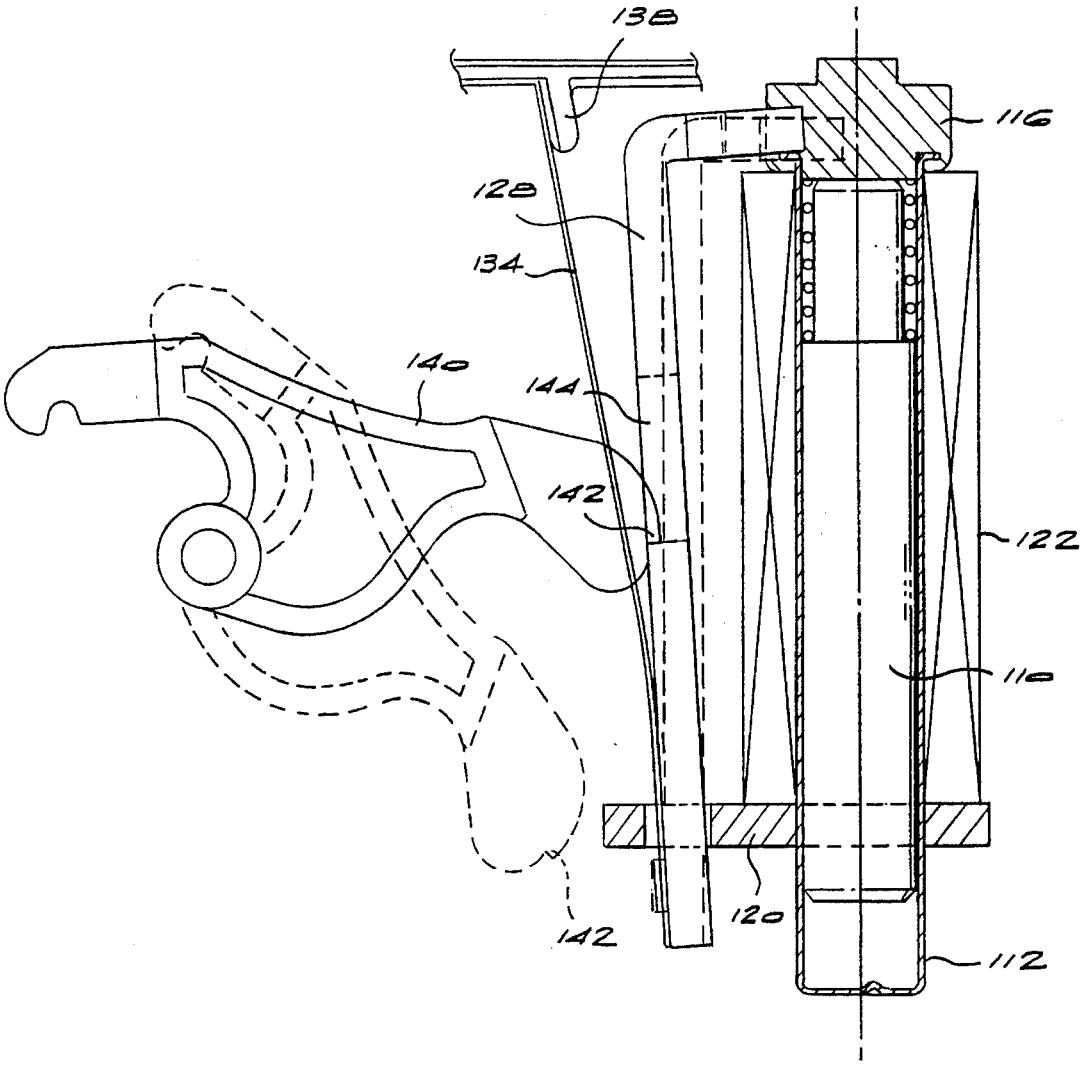
FIG. 4 is a partial sectional side view of the mechanism, showing the interaction of the armature and a tripping lever of the circuit breaker mechanism.

FIGS. 2 to 4 illustrate the actuating mechanism of the present invention. Similarly to the mechanism of FIG. 1, a magnetic plunger 110 is located in a tube 112, which is typically formed from brass or another non-magnetic material, and which is filled with a hydraulic fluid 114. A pole piece 116 which has a substantially disc shaped central portion is press fitted into the upper end of the tube 112. An annular slot is cut in the lowermost side of the central, enlarged portion of the pole piece to receive an outwardly-turned lip at the upper end of the tube 112, with the outer wall of the slot being crimped inwardly as shown to retain the pole piece in the tube in a fluid-tight manner. A coil spring 118 urges the plunger 110 away from the pole piece 116.

A magnetic frame 120 is fixed to the tube 112 towards the end thereof remote from the pole piece 116, and supports a load coil 122 which surrounds the tube 112. As shown in FIG. 3*b*, the magnetic frame 120 simply comprises a length of flat mild steel sheet or bar stock which is cut into a rectangular shape and which is formed with a circular aperture 124 which receives the tube 112, and a second, smaller rectangular aperture 126 which receives a magnetic armature 128.

Turning again to FIG. 2, the armature 128 is seen to be formed from a length of mild steel bar or sheet, and is folded into an L-shape. The armature has a head 130 which is formed in the foot of the L, and the top end of the L is formed as a locating tab 132 which fits freely into the slot 126 in the magnetic frame 120.

As best seen in FIG. 3*a*, the head 130 defines a semi-circular recess 134 which is shaped complementally to the circular section of the enlarged central portion of the pole piece 116. When the armature 128 is moved transversely (relative to the axis of the coil 122 and the plunger 110) towards the pole piece, the profiles of the pole piece and the recess 134 match closely.

A leaf spring 134 comprising a strip of phosphor bronze or another non-magnetic resilient material is fixed to the armature at the back of the tab 132 by means of a stacking operation, in which a hole in the lower end of the spring is fitted over a protrusion 136 pressed into the tab, the protrusion then being flattened to secure the spring. The other end of the spring bears against a ridge 138 in the moulded casing of a circuit breaker to bias the armature away from the pole piece. When a sufficiently large load current exists in the coil 122, the head 130 of the armature and the pole piece are magnetically attracted and the resultant force overcomes the resistance of the spring 134 and the friction of the circuit breaker operating mechanism (see FIG. 4) to cause the armature to move towards the pole piece, thus causing the mechanism to trip.

The mechanism of the present invention retains the desirable characteristics of the prior art mechanism described above, ie. a delayed tripping action in the case of moderate overcurrents, and instantaneous tripping in the case of severe overcurrents.

FIG. 4 shows the mechanism of FIGS. 2 and 3 together with part of a circuit breaker tripping mechanism. A tripping lever 140 of the tripping mechanism is shown in a latched position (in solid outline) and a tripped position (in dotted outline), corresponding to the retracted and pulled-in positions of the armature 128 (shown in solid and dotted outline respectively). The tripping lever 140 has a lip 142 which engages the lower edge of a rectangular slot 144 formed centrally in the armature.

When the armature moves towards the pole piece, the tripping lever is released and moves to the position shown in dotted outline in FIG. 4, operating the circuit breaker mechanism.

From FIG. 3*a*, it can be seen that the projecting extreme end portions 146 and 148 of the head 130 of the armature are relatively close to the pole piece 116, even when the armature is in the retracted position shown. The clearance between the end portions 146 and 148 and the pole piece 116 is 2 to 3 times less than the clearance between the central portion of the recess 134 and the pole piece. This results in a greater initial attractive force between the armature and pole piece than would be the case with the conventional mechanism of FIG. 1, without sacrificing a desirably long range of travel. In addition, because of the relatively long lever formed by the upright portion of the L of the armature 128, the operating force of the illustrated mechanism is relatively high. The combination of these two factors results in an increase in the operating force of the mechanism of 25% or more, compared with the conventional mechanism illustrated in FIG. 1.

In addition to the above advantages, it will be appreciated that the mechanism shown in FIGS. 2 and 3 is both simple and inexpensive to manufacture, with components which can be stamped from sheet or bar stock. The fit between the tab 132 of the armature 128 and the aperture 126 in the magnetic frame 122 is not critical, so that the described mechanism is less sensitive to tolerance variations in manufacture. The mechanism dispenses with the need for an armature pivot pin, and the leaf spring 134 is less expensive to manufacture than the conventionally used torsion spring.

Thus, the described mechanism is both cheaper and simpler to manufacture, can be assembled fully automatically and offers performance advantages compared to the conventional mechanism.

In order to provide desired operating characteristics of the mechanism, the relative shapes of the pole piece 116 and the head 130 of the armature can be varied. The relative length of the edge portions 146 and 148 of the armature head, and the respective shapes of the pole piece 116 and the recess 134 in the head, will determine the force/travel characteristics of the mechanism.

We claim:

1. A circuit breaker actuating mechanism comprising:

a magnetic frame;

a coil arranged to carry a load current and defining an axis;

a magnetic pole piece aligned with the axis of the coil and arranged to concentrate magnetic flux due to current in the coil; and an armature supported by the magnetic frame and being movable transversely relative to the axis of the coil, the armature having a head located adjacent to the pole piece which is movable radially towards the pole piece, the head being shaped complementally to the shape of the pole piece so that at least a portion of the head is disposed relatively closer to the pole piece than the rest of the head when the armature is in a retracted position, to increase the initial attractive force between the pole piece and the armature when the armature is pulled in.

2. A mechanism according to claim 1 wherein the armature is L-shaped and is connected to the magnetic frame at the top of the L, with the head of the armature formed in the foot of the L.

3. A mechanism according to claim 1 wherein the pole piece is circular in section, with the head of the armature having a complemental circular recess formed therein.

4. A mechanism according to claim 1 wherein the clearance between the at least one projecting end portion of the head of the armature and the pole piece is at least twice as small as the clearance between a central portion of the head of the armature and the pole piece.

5. A mechanism according to claim 1 wherein the armature has a retaining formation at the end thereof opposite the head which engages a complemental formation formed in the magnetic frame, to allow pivotal movement of the armature relative to the frame.

6. A mechanism according to claim 5 wherein the retaining formation of the armature is a projecting tab and the complemental formation in the magnetic frame is an aperture which receives the tab.

7. A mechanism according to claim 1 wherein the armature is biased into a retracted position away from the pole piece by a leaf spring connected to the armature and bearing, in use, on a formation defined by a housing in which the mechanism is retained.

* * * * *